US006925151B2

(12) United States Patent
Harding et al.

(10) Patent No.: US 6,925,151 B2
(45) Date of Patent: Aug. 2, 2005

(54) DEVICE FOR GENERATING X-RAYS

(76) Inventors: Geoffrey Harding, Jevenstedter Strasse 170D, D-22547 Hamburg (DE); Bernd David, Dorfstrasse 20, D-24641 Huettblek (DE); Jens Peter Schlomka, Geibelstrasse 42, D-22303 Hamburg (DE); Leonardus Petrus Maria Tielemans, Prof. Holstlaan 6, 5656 AA Eindhoven (NL); Willem Potze, Prof. Holstlaan 6, 5656 AA Eindhoven (NL)

( * ) Notice: Subject to any disclaimer, the term of this patent is extended or adjusted under 35 U.S.C. 154(b) by 252 days.

(21) Appl. No.: 10/257,996

(22) PCT Filed: Jan. 30, 2002

(86) PCT No.: PCT/IB02/00335

§ 371 (c)(1),
(2), (4) Date: Oct. 15, 2002

(87) PCT Pub. No.: WO02/065505

PCT Pub. Date: Aug. 22, 2002

(65) Prior Publication Data

US 2003/0142789 A1 Jul. 31, 2003

(30) Foreign Application Priority Data

Feb. 14, 2002 (DE) ..... 101 06 740

(51) Int. Cl.[7] ..... H01J 35/00
(52) U.S. Cl. ..... 378/119; 378/125; 378/127
(58) Field of Search ..... 378/125, 127, 378/119, 143, 141, 199, 200, 132, 133

(56) References Cited

U.S. PATENT DOCUMENTS 4,551,800 A 11/1985 Riederer et al.
4,559,557 A 12/1985 Keyes et al.
4,953,191 A * 8/1990 Smither et al. ..... 378/143
5,052,034 A 9/1991 Schuster
6,185,277 B1 2/2001 Harding

FOREIGN PATENT DOCUMENTS

DE 890 246 9/1953

OTHER PUBLICATIONS

PCT International Search Report for International application No. PCT/IB 02/00335.
French Search Report for Patent application No. 200111441 of Apr. 9, 2001.

* cited by examiner

*Primary Examiner*—Edward J. Glick
*Assistant Examiner*—Elizabeth Keaney
(74) *Attorney, Agent, or Firm*—Wayne M. Serra

(57) ABSTRACT

The invention relates to a device (1) for generating X-rays (57). The device comprises a source (7) for emitting electrons (53) and a liquid metal for emitting X-rays as a result of the incidence of electrons. The device further comprises a displacing member (11) for displacing the liquid metal through an impingement position (55) where the electrons emitted by the source impinge upon the liquid metal. As a result of the flow of liquid metal through the impingement position the heat, which is generated in the impingement position as a result of the incidence of the electrons upon the liquid metal, is transported away from the impingement position.

According to the invention, the displacing member (11) has a contact surface (61), which is in contact with the liquid metal in the impingement position (55), and a driving member (31) for moving the contact surface in a direction which, in the impingement position, is substantially parallel to the contact surface. Thus the flow of liquid metal in the impingement position is achieved as a result of viscous shear forces in the liquid metal caused by friction forces between the liquid metal and the moving contact surface. As a result, the necessary pressure of the liquid metal is limited.

15 Claims, 6 Drawing Sheets

DEVICE FOR GENERATING X-RAYS

BACKGROUND

The invention relates to a device for generating X-rays, which device comprises a source for emitting electrons, a liquid metal for emitting X-rays as a result of the incidence of electrons, and a displacing member for displacing the liquid metal through an impingement position where the electrons emitted by the source impinge upon the liquid metal.

A known device for generating X-rays is described in U.S. Pat. No. 6,185,277-B1. During operation of the known device, the liquid metal, e.g. mercury, flows through a narrow passage which forms part of a closed cyclical channel system. Said narrow passage is bounded by a relatively thin window made from a material which is transparent to X-rays and electrons, e.g. diamond. The window separates the liquid metal from a vacuum space in which the source is accommodated. The source generates an electron beam, which passes through the window and impinges upon the liquid metal in the impingement position behind the window. The X-rays, emitted by the liquid metal as a result of the incidence of the electron beam, emanate through the window and through an X-ray exit window, which is provided in a housing surrounding the vacuum space. The velocity of the liquid metal flow in the narrow passage is relatively high, so that the flow in this passage is highly turbulent. As a result of this turbulent flow, the heat, which is generated in the impingement position as a result of the incidence of the electron beam upon the liquid metal, is transported away from the impingement position in a considerably effective manner, so that an increase of the temperature of the liquid metal in the impingement position is limited. The channel system further comprises a heat exchanger by means of which the liquid metal is cooled down. The displacing member, by means of which the liquid metal is displaced through the narrow passage, the heat exchanger, and the other parts of the channel system, is a pump which is arranged in the channel system between the heat exchanger and the narrow passage.

A disadvantage of the known device for generating X-rays is that the pump has to generate a relatively high pressure of the liquid metal in order to obtain flow velocities in the narrow passage which are sufficiently high to obtain a sufficient rate of heat transport away from the impingement position by the liquid metal flow. This is the result of relatively high pressure losses of the liquid metal flow in the narrow passage. As a result, a relatively heavy and robust pump has to be used, and also other parts of the device, which are exposed to the high pressure, have to be constructed in a robust manner. This causes the known device to be less suitable for use in systems where a large weight and large dimensions of the device are not practical or even intolerable, which is particularly the case in medical X-ray examination systems. Furthermore, the relatively thin X-ray and electron transparent window may easily break as a result of the high pressure, causing malfunction of the device.

SUMMARY OF THE INVENTION

An object of the invention is to provide a device for generating X-rays of the kind mentioned in the opening paragraph in which the necessary pressure of the liquid metal is limited, so that the above mentioned disadvantages are avoided as much as possible.

In order to achieve said object, a device for generating X-rays according to the invention is characterized in that said displacing member comprises a contact surface, which is in contact with the liquid metal in the impingement position, and a driving member for moving said contact surface in a direction which, in the impingement position, is substantially parallel to the contact surface. In the device according to the invention, a flow of liquid metal in the impingement position is achieved as a result of viscous shear forces in the liquid metal, which are caused by the moving contact surface. Since, in the impingement position, the contact surface is moved in a direction substantially parallel to the contact surface, the liquid metal in the impingement position is displaced under the influence of said shear forces in said direction, i.e. away from the impingement position. If the velocity of the contact surface and, as a result, the shear forces are sufficiently high, a sufficient rate of heat transport away from the impingement position can be achieved. Since the liquid metal flow in the impingement position is thus achieved by means of viscous shear forces and not by means of a pressure of the liquid metal upstream of the impingement position, the necessary pressure of the liquid metal is limited. The necessary pressure is mainly determined by pressure losses in other parts of the flow channel of the liquid metal, which can be limited by suitable dimensions of said parts.

A particular embodiment of a device for generating X-rays according to the invention is characterized in that the source is accommodated in a vacuum space which is separated, near the impingement position, from the liquid metal by a window made from a material which is transparent to X-rays and electrons, said contact surface and said window constituting opposite walls of a duct for the liquid metal. The window prevents the vacuum space from being contaminated by the liquid metal. As a result of the moving contact surface, a Couette flow is achieved in the duct between the window and the contact surface. When the velocity of the moving contact surface is sufficiently high, said Couette flow will be turbulent, as a result of which the rate of heat transport away from the impingement position will be considerably increased.

A further embodiment of a device for generating X-rays according to the invention is characterized in that said duct forms part of a closed cyclical channel system comprising a heat exchanger. In this embodiment, the liquid metal circulates through the channel system in a cyclical manner, the liquid metal being heated in the impingement position and subsequently being cooled down again in the heat exchanger. The necessary pressure of the liquid metal is mainly determined by the pressure losses in the heat exchanger, which can be limited by suitable dimensions of the heat exchanger.

A yet further embodiment of a device for generating X-rays according to the invention is characterized in that the displacing member comprises a carrier, which has a substantially circular-cylindrical outer surface and is rotatable about a central axis of said outer surface by means of the driving member, the contact surface forming part of said outer surface. In this embodiment, the device has a compact and practical construction in that the displacing member is integrated into the device in a compact and practical way. The carrier is, for example, provided with a rotatable drum or cylinder comprising said circular-cylindrical outer surface. Between the rotatable carrier and the window, a gap is present, the contact surface being constituted by a portion, opposite to the window, of the circular-cylindrical outer surface. Said gap extends parallel to the central axis, and in the gap a Couette flow of the liquid metal is generated in a tangential direction relative to the central axis when the carrier is rotated.

A particular embodiment of a device for generating X-rays according to the invention is characterized in that the displacing member comprises a substantially disc-shaped carrier which is rotatable about its central axis by means of the driving member, the contact surface forming part of an annular portion of a first main outer surface of said carrier, which portion is present near the circumference of said carrier. Also in this embodiment, the device has a compact and practical construction in that the displacing member is integrated into the device in a compact and practical way. Between the rotatable carrier and the window, a gap is present, the contact surface being constituted by a portion, opposite to the window, of said annular portion of the first main outer surface. Said gap extends perpendicular or transverse to the central axis, and in the gap a Couette flow of the liquid metal is generated in a tangential direction relative to the central axis, i.e. in a circumferential direction relative to the carrier, when the carrier is rotated. Since the contact surface, and hence the impingement position are situated near the circumference of the disc-shaped carrier, a relatively high tangential velocity of the contact surface is achieved.

A further embodiment of a device for generating X-rays according to the invention is characterized in that the carrier is arranged in a substantially circular-cylindrical chamber, wherein a first substantially disc-shaped gap is present between a first main inner surface of said chamber and the first main outer surface of the carrier, a second substantially disc-shaped gap is present between a second main inner surface of said chamber and a second main outer surface of the carrier, and a substantially annular circumferential gap is present between a circumferential inner surface of said chamber and a circumferential outer surface of the carrier, the channel system comprising a supply channel, which is connected to said chamber near the central axis, and an outlet channel, which is connected to said circumferential gap, the heat exchanger being arranged between said supply channel and said outlet channel. In this embodiment, as a result of the rotation of the carrier, centrifugal forces are exerted on the liquid metal which is present in the two disc-shaped gaps. These centrifugal forces generate a radial flow of the liquid metal from the supply channel in radial direction towards said circumferential gap, which surrounds the carrier. Under the influence of said radial flow, liquid metal present in the circumferential gap is urged to flow into the outlet channel towards the heat exchanger and back again via the supply channel. In this manner, the liquid metal is effectively urged to circulate through the channel system. The radial flow, which is also present in the impingement position in addition to the tangential Couette flow, further increases the rate of heat transport away from the impingement position.

A yet further embodiment of a device for generating X-rays according to the invention is characterized in that at least the first main outer surface of the carrier is provided with pumping means for providing a radial pumping action in the first disc-shaped gap. Said pumping means comprise, for example, a plurality of vanes on said main outer surface or a plurality of grooves in said main outer surface, and increase the radial flow of the liquid metal in the first disc-shaped gap and, hence, the circulation of the liquid metal in the channel system.

A particular embodiment of a device for generating X-rays according to the invention is characterized in that the displacing member comprises a carrier, which has a substantially conical inner surface and is rotatable about a central axis of said inner surface by means of the driving member, wherein said carrier and the source are accommodated in a common vacuum space, and wherein the contact surface forms part of an annular portion of said inner surface which is present near an edge of said inner surface where said inner surface has its largest diameter. Also in this embodiment, the device has a compact and practical construction in that the displacing member is integrated into the device in a compact and practical way. The carrier is accommodated in the vacuum space in which the source is present, and a liquid metal flow with a free surface is achieved over the conical inner surface by rotating the carrier about the central axis. In this manner, a fragile X-ray and electron transparent window is not necessary, as a result of which the risk of malfunction is limited. The carrier is rotated about the central axis at a relatively high velocity, and the contact surface is situated near the circumference of the disc-shaped carrier, so that a relatively high tangential velocity of the contact surface is achieved in the impingement position. As a result, a relatively high rate of heat transport away from the impingement position is achieved. In addition, a relatively high centrifugal force is exerted on the liquid metal present on the conical inner surface. Said centrifugal force causes the liquid metal to flow in radial direction and to maintain in contact with the conical inner surface without contamination of the vacuum space.

A further embodiment of a device for generating X-rays according to the invention is characterized in that the displacing member comprises a further carrier, which is connected to the carrier and has a substantially conical outer surface, wherein a substantially conical gap is present between said outer surface and the inner surface, and wherein the annular portion of the inner surface is not covered by said further carrier. As a result of the presence of said further carrier, the average tangential velocity of the liquid metal flow in the impingement position is increased, so that also the rate of heat transport away from the impingement position is increased. In addition, the average centrifugal force exerted on the liquid metal is increased, as a result of which the risk of contamination of the vacuum space by the liquid metal is further reduced.

A yet further embodiment of a device for generating X-rays according to the invention is characterized in that the further carrier is connected to the carrier by means of pumping vanes, which are present in the gap for providing a radial pumping action in the gap. As a result of said radial pumping action, the flow of liquid metal in the radial direction is increased, so that the rate of heat transport away from the impingement position is further increased.

A particular embodiment of a device for generating X-rays according to the invention is characterized in that the liquid metal is supplied to the inner surface from a chamber which is present near an edge of the inner surface where the inner surface has its smallest diameter, wherein the device further comprises a supply channel, which is connected to said chamber, an outlet channel, which is connected to an annular further chamber surrounding the edge of the inner surface where the inner surface has its largest diameter, and a heat exchanger arranged between said supply channel and said outlet channel. The centrifugal forces, which are exerted on the liquid metal present on the conical inner surface, generate a radial flow of the liquid metal from the edge, where the inner surface has its smallest diameter, to the edge, where the inner surface has its largest diameter, and further into the annular further chamber. Under the influence of said radial flow, liquid metal present in the annular further chamber is urged to flow into the outlet channel towards the heat exchanger, and back again via the supply channel into said chamber. In this manner, the liquid metal is effectively urged to circulate in a closed loop comprising the conical inner surface and the heat exchanger.

A further embodiment of a device for generating X-rays according to the invention is characterized in that the carrier is rotatably journalled by means of a dynamic groove bearing comprising a bearing gap filled with the liquid metal. The dynamic groove bearing is thus integrated into the closed channel system for the liquid metal, as a result of which the construction of the device is further simplified. The liquid metal, by means of which the X-rays are generated, is also used as a lubricant for the dynamic groove bearing, so that the liquid metal is effectively used.

The following description, claims and accompanying drawings set forth certain illustrative embodiments applying various principles of the present invention. It is to be appreciated that different embodiments applying principles of the invention may take form in various components, steps and arrangements of components and steps. These described embodiments being indicative of but a few of the various ways in which some or all of the principles of the invention may be employed in a method or apparatus. The drawings are only for the purpose of illustrating an embodiment of an apparatus and method applying principles of the present invention and are not to be construed as limiting the present invention.

BRIEF DESCRIPTION OF THE DRAWINGS

The foregoing and other features and advantages of the present invention will become apparent to those skilled in the art to which the present invention relates upon consideration of the following detailed description of apparatus applying aspects of the present invention with reference to the accompanying drawings, wherein.

DETAILED DESCRIPTION

Figure 1:
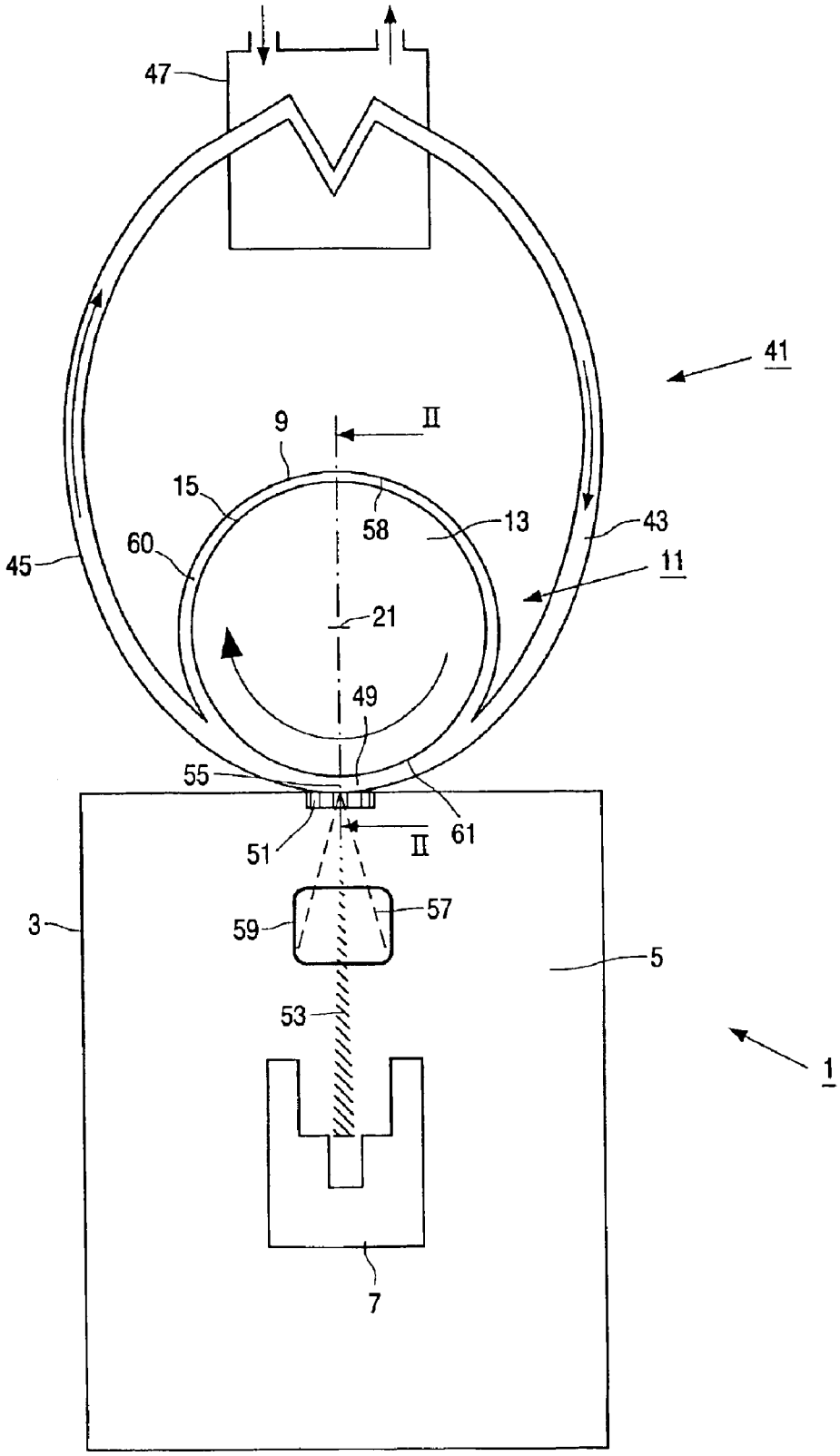
FIG. 1 schematically shows a first embodiment of a device for generating X-rays according to the invention, FIG. 2 schematically shows a section taken on the line II—II in FIG. 1, FIG. 3 schematically shows a Couette flow in an impingement position of the device of FIG. 1, FIG. 4 schematically shows a second embodiment of a device for generating X-rays according to the invention, FIG. 5 schematically shows a top view of a disc-shaped carrier of the device of FIG. 4, FIG. 6 schematically shows a third embodiment of a device for generating X-rays according to the invention, and FIG. 7 schematically shows a top view of a conical carrier of the device of FIG. 6.
Figure 2:
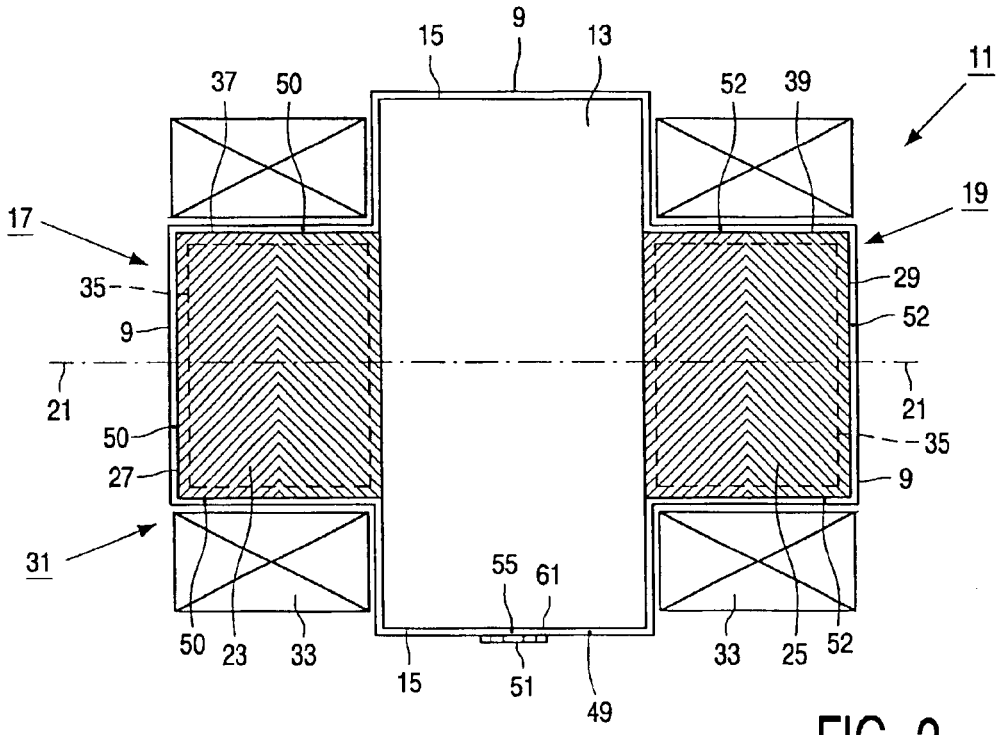

As schematically shown in FIG. 1, the first embodiment of a device 1 for generating X-rays according to the invention comprises a housing 3 enclosing a vacuum space 5 in which a source 7 or cathode for emitting electrons is present. The device 1 further comprises a closed circular-cylindrical chamber 9 which is mounted to the housing 3 in a manner which is not further disclosed in detail. In said chamber 9, a displacing member 11 is present comprising a carrier 13, in the embodiment shown comprising a closed cylinder, having a circular-cylindrical outer surface 15. As shown in FIG. 2, the carrier 13 is journalled by means of dynamic groove bearings 17, 19 relative to the chamber 9 so as to be rotatable about a central axis 21 of the outer surface 15. The dynamic groove bearings 17, 19 are of a kind which is known per se, and are each provided with a radial bearing part 23, 25 for generating bearing forces in a radial direction and with an axial bearing part 27, 29 for generating bearing forces in an axial direction. The displacing member 11 is further provided with a driving member 31 for rotating the carrier 13 about the central axis 21. In the embodiment shown, the driving member 31 comprises an induction motor which is known per se and which comprises two stator parts 33, which are present outside the chamber 9, and two rotor parts 35, which are mounted in two pivots 37, 39 of the carrier 13 which also carry the dynamic groove bearings 17, 19. Said stator parts 33 and said rotor parts 35 are only schematically shown in FIG. 2.

As shown in FIG. 1, the device 1 is further provided with a closed cyclical channel system 41, which comprises a supply channel 43, an outlet channel 45, a heat exchanger 47, and a relatively narrow duct 49, which is present between the outer surface 15 of the carrier 13 and an X-ray and electron transparent window 51. Said window 51 comprises a relatively thin plate made from a material which is transparent to X-rays and electrons, such as diamond or beryllium, and separates the vacuum space 5 from the duct 49. The channel system 41 is filled with a liquid metal, such as gallium, mercury, a mercury alloy, or an alloy containing lead and bismuth, which has the property of emitting X-rays as a result of the incidence of electrons. The window 51 prevents the vacuum space 15 from being contaminated by the liquid metal. As shown in FIG. 2, the duct 49 is also connected to bearing gaps 50, 52 of the dynamic groove bearings 17, 19. As a result, also the bearing gaps 50, 52 are filled with the liquid metal, which is thus also used as a necessary lubricant for the dynamic groove bearings 17, 19. In this manner, the bearing gaps 50, 52 are integrated into the channel system 41, so that the construction of the device 1 is simplified.

During operation of the device 1, an electron beam 53 is generated by the source 7. The beam 53 passes through the window 51 and impinges upon the liquid metal in an impingement position 55 which is present behind the window 51. X-rays 57, emitted by the liquid metal as a result of the incidence of the beam 53, emanate through the window 51 and through an X-ray exit window 59, which is made from beryllium and is provided in the housing 3. As a result of the incidence of the electron beam 53 upon the liquid metal, a large amount of heat is generated in the impingement position 55. To avoid excessive heating of the liquid metal in the impingement position 55 and of the parts of the device 1 surrounding the impingement position 55, said heat is transported away from the impingement position 55 by a flow of the liquid metal in the duct 49 through the impingement position 55, which is generated by rotating the carrier 13 about the central axis 21. As a result of said flow, the liquid metal circulates through the channel system 41 in a cyclical manner, whereby the liquid metal is heated in the impingement position 55 and is subsequently cooled down again in the heat exchanger 47. In the embodiment of FIG. 1 suitable sealing means, which are not shown, are provided between the carrier 13 and an inner wall 58 of the chamber 9 to prevent the liquid metal from flowing through a gap 60 which is present between the carrier 13 and the inner wall 58. However, it is noted that alternatively the liquid metal can be allowed to flow also through the gap 60, as a result of which an additional cooling of the liquid metal can be achieved via the inner wall 58 of the chamber 9 and via the carrier 13. In particular when the device 1 is intended for generating X-rays of a relatively low energy level, the heat exchanger 47, the supply channel 43, and the outlet channel 45 may even be omitted, so that the liquid metal is only cooled down in the gap 60. It is further noted that, in case a source 7 is used which generated a line focus in the impingement position 55, the source 7 should be positioned in such a manner that said line focus extends substantially parallel to the central axis 21 in order to achieve an optimal rate of heat transport away from the impingement position 55.

Figure 3:
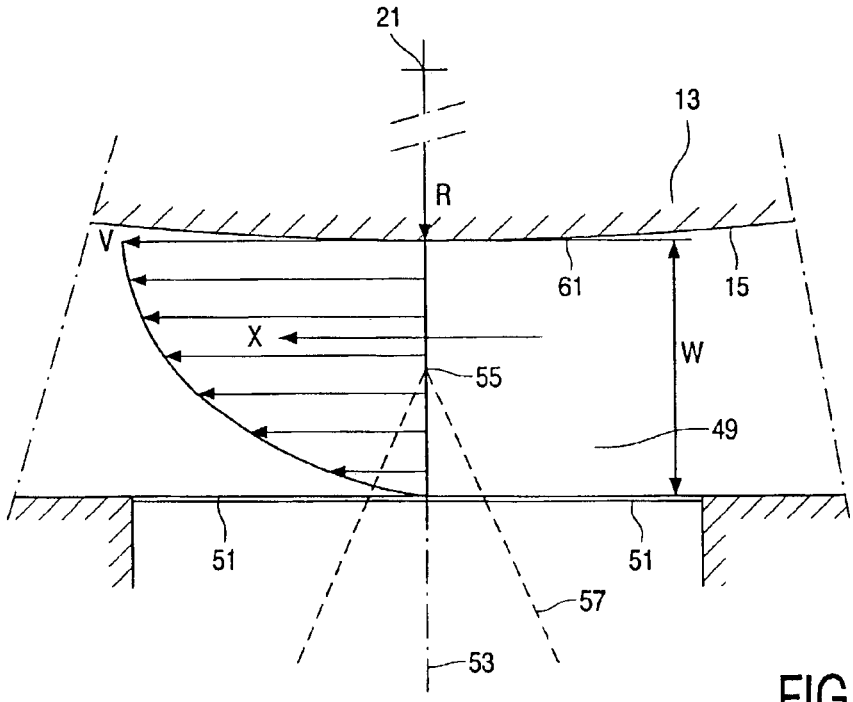

As shown in FIG. 3, the flow of liquid metal in the duct 49 is a Couette flow in a tangential direction relative to the central axis 21. Said Couette flow is generated as a result of the fact that the liquid metal in the duct 49 and in the impingement position 55 is in contact with a contact surface 61 of the displacing member 11, and that the contact surface 61 is moved by the driving member 31 in a direction X which, in the impingement position 55, is substantially parallel to the contact surface 61. The contact surface 61 is a portion of the circular-cylindrical outer surface 15, which bounds the duct 49 opposite to the window 51. The Couette flow is the result of viscous shear forces in the liquid metal, which are caused by viscous friction forces in the liquid metal and between the liquid metal and the moving contact surface 61. Under the influence of said shear forces, the liquid metal is displaced mainly in said direction X parallel to the contact surface 61, i.e. away from the impingement position 55. This results in an effective transport of heat away from the impingement position 55, a rate of heat transport being determined by the flow velocity in the duct 49 and, hence, by the velocity V of the contact surface 61. In the embodiment shown, the velocity V is sufficiently high to cause the Couette flow to be turbulent, as a result of which the rate of heat transport away from the impingement position 55 is considerably increased. A turbulent Couette flow is achieved when the Taylor number $T_a$ of said flow is larger than approximately 50, said number being defined by $T_a=(V.w/v).\sqrt{(w/R)}$, wherein w is a width of the duct 49, R is a radius of the outer surface 15, and ν is the kinematic viscosity of the liquid metal. In the embodiment shown, a value $T_a=250$ is achieved with a width w=200 μm, a radius R=5 cm, a velocity V=6 m/s (rotational frequency 19 Hz), and a viscosity $\nu=3.10^{-7}$ $m^2/s$ (gallium).

Since the flow of liquid metal through the relatively narrow duct 49 is achieved by means of shear forces in the liquid metal generated by the moving contact surface 61, the liquid metal is forced through the duct 49 without the necessity of a relatively high pressure upstream of the duct 49. The necessary pressure of the liquid metal, which is to be generated by the displacing member 11, is mainly determined by the pressure losses in the heat exchanger 47, the supply channel 43, and the outlet channel 45. These pressure losses can be limited by suitable dimensions of the heat exchanger 47, the supply channel 43, and the outlet channel 45. As a result, the pressure of the liquid metal in the device 1 according to the invention is relatively low, as a result of which the dimensions and the weight of the parts of the device 1, which are exposed to the pressure of the liquid metal, can be limited. Furthermore, the risk that the relatively thin X-ray and electron transparent window 51 will break under the influence of the pressure of the liquid metal, is considerably reduced, so that the reliability of the device 1 is strongly improved. Furthermore, the displacing member 11 is integrated in a practical and compact manner into the device 1, so that the device 1 has a compact construction. These advantages cause the device 1 to be suitable for use in systems where a large weight and/or large dimensions of the device 1 would not be practical or even intolerable, which is particularly the case in medical X-ray examination systems.

Figure 4:
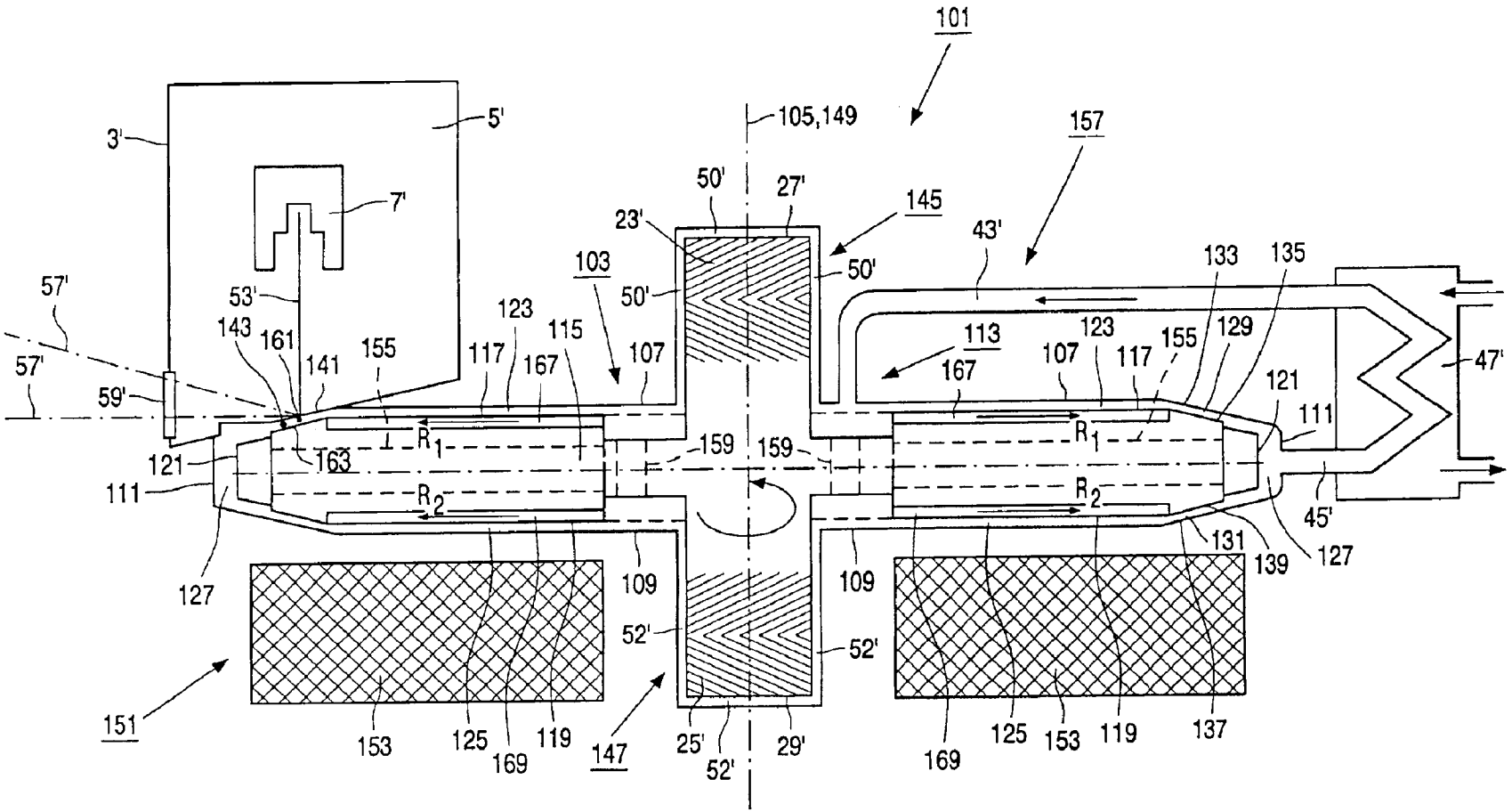

In FIG. 4 parts of the second embodiment of a device 101 for generating X-rays according to the invention, which correspond to parts of the device 1 as shown in FIGS. 1–3, are indicated with corresponding reference numbers. In the following, the differences between the devices 1 and 101 will be discussed. In the device 101, the housing 3' accommodating the source 7' is mounted to a substantially circular-cylindrical closed chamber 103 having a central axis 105 and comprising a first main inner surface 107 and a second main inner surface 109, which extend substantially perpendicularly to the central axis 105, and a circular-cylindrical circumferential inner surface 111. In the chamber 103 a displacing member 113 is present, which comprises a substantially disc-shaped carrier 115 having a first main outer surface 117, which extends substantially parallel to the first main inner surface 107 of the chamber 103, a second main outer surface 119, which extends substantially parallel to the second main inner surface 109 of the chamber 103, and a circular-cylindrical circumferential outer surface 121. A first substantially disc-shaped gap 123 is present between said first main inner surface 107 and said first main outer surface 117, a second substantially disc-shaped gap 125 is present between said second main inner surface 109 and said second main outer surface 119, and a substantially annular circumferential gap 127 is present between said circumferential inner surface 111 and said circumferential outer surface 121. Said first disc-shaped gap 123 and said second disc-shaped gap 125 are connected to said circumferential gap 127 via, respectively, a relatively narrow first annular gap 129 and a second annular gap 131, which extend slightly obliquely relative to the central axis 105. The first annular gap 129 is bounded by an annular portion 133 of the first main inner surface 107 and by an annular portion 135 of the first main outer surface 117, and the second annular gap 131 is bounded by an annular portion 137 of the second main inner surface 109 and by an annular portion 139 of the second main outer surface 119, said annular portions 133, 135, 137, 139 likewise extending slightly obliquely relative to the central axis 105. In said annular portion 133 of the first main inner surface 107 an X-ray and electron transparent window 141 is provided, which separates the vacuum space 5' from a duct 143, which constitutes a portion of the first annular gap 129 present behind the window 141.

The carrier 115 is journalled by means of dynamic groove bearings 145, 147 relative to the chamber 103 so as to be rotatable about a central axis 149 of the carrier 115, which coincides with the central axis 105 of the chamber 103. Like the bearings 17, 19 of the device 1, the bearings 145, 147 comprise radial bearing parts 23', 25' and axial bearing parts 27', 29'. The displacing member 113 is further provided with a driving member 151 for rotating the carrier 115 about the central axis 149. Like the driving member 31 of the device 1, the driving member 151 comprises an induction motor with a stator part 153, which is present outside the chamber 103, and with a rotor part 155, which is mounted in the carrier 115.

A liquid metal for emitting X-rays as a result of the incidence of electrons is present in a closed cyclical channel system 157 of the device 101, which comprises the supply channel 43', the outlet channel 45', the heat exchanger 47', the first disc-shaped gap 123, the second disc-shaped gap 125, the first annular gap 129 including the duct 143, the second annular gap 131, the circumferential gap 127, and a plurality of openings 159 connecting the first and the second disc-shaped gaps 123, 125 near the central axis 105. Said liquid metal is also present as a necessary lubricant in the bearing gaps 50', 52' of the dynamic groove bearings 145,

147, which are connected to, respectively, the first disc-shaped gap 123 and the second disc-shaped gap 125. As shown in FIG. 4, the supply channel 43' is connected to the chamber 103 near the central axis 105, and the outlet channel 45' is connected to the circumferential gap 127.

Figure 5:
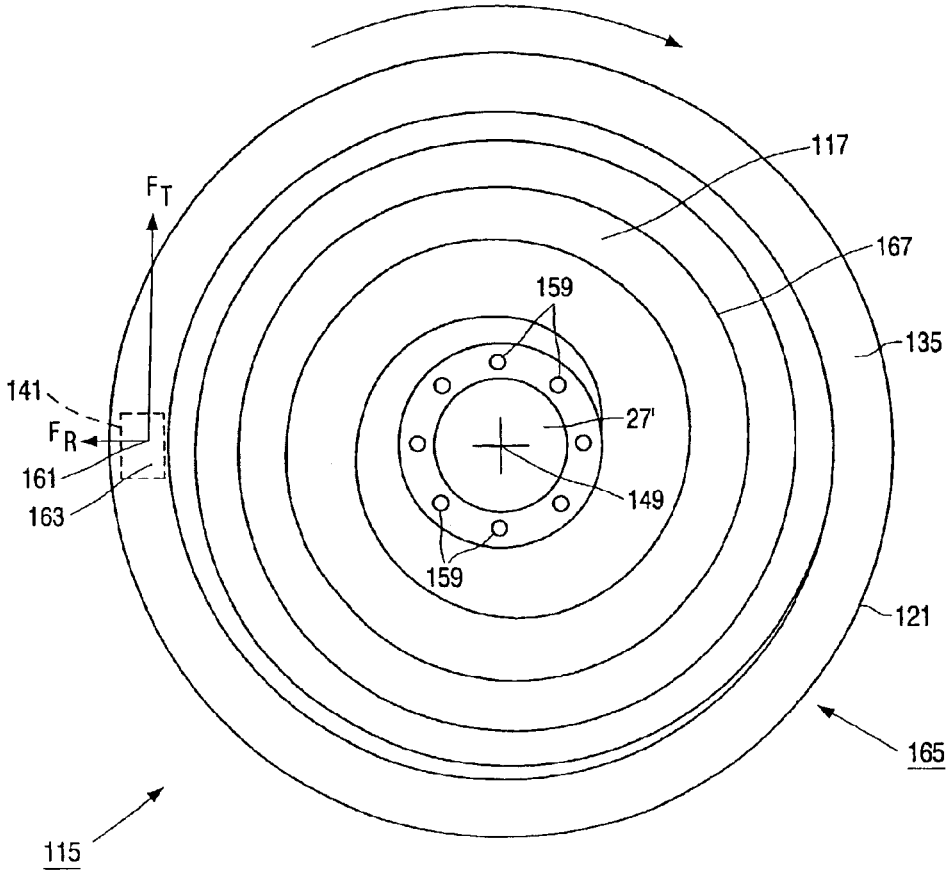

During operation of the device 101, the electron beam 53' generated by the source 7' passes through the window 141 and impinges upon the liquid metal in an impingement position 161. The X-rays 57', emitted by the liquid metal in the impingement position 161, emanate through the window 141 and through the X-ray exit window 59' provided in the housing 3'. Like in the device 1, also in the device 101 the heat generated in the impingement position 161 is transported away from the impingement position 161 by a flow of the liquid metal in the duct 143 through the impingement position 161, which flow is generated by rotating the carrier 115 about its central axis 149. As schematically shown in FIG. 5, said flow in the device 101 has a component $F_T$ in a tangential direction relative to the central axis 149, i.e. in a circumferential direction relative to the carrier 115, and a component $F_R$ in a radial direction relative to the central axis 149.

The flow component $F_T$ is a Couette flow which is generated as a result of the fact that the liquid metal in the duct 143 and in the impingement position 161 is in contact with a contact surface 163 of the displacing member 113, and that said contact surface 163 is moved, as a result of the rotation of the carrier 115 by means of the driving member 151, in said tangential direction. In the device 101, the contact surface 163 is a portion of the annular portion 135, opposite to the window 141, of the first main outer surface 117 of the carrier 115. In the impingement position 161, said tangential direction of the component $F_T$ is substantially parallel to the contact surface 163, so that the heat is transported away from the impingement position 161 in an effective manner and is in some degree distributed over the first annular gap 129. The annular portion 135 including the contact surface 163 is present near the circumferential outer surface 121 of the carrier 115, so that the velocity of the contact surface 163 and, hence, of the flow component $F_T$ is relatively high, and a relatively high rate of heat transfer away from the impingement position 161 is achieved. Like in the device 1, the velocity of the flow component $F_T$ is sufficiently high to cause the Couette flow to be turbulent.

The flow component $F_R$ is the result of a radial pumping action in the first disc-shaped gap 123, which is mainly achieved by pumping means 165 provided on the first main outer surface 117 of the carrier 115. As schematically shown in FIG. 5, the pumping means 165 comprise a spiral pumping groove 167 which is provided in the main outer surface 117. Alternatively, said pumping means 165 may comprise a plurality of pumping grooves in the main outer surface 117 or one or more pumping vanes provided on the main outer surface 117. During rotation of the carrier 115, the pumping groove 167 generates a radial flow $R_1$ (see FIG. 4) of the liquid metal in the first disc-shaped gap 123. Said radial flow $R_1$ does not only cause the flow component $F_R$ from the duct 143 and from the first annular gap 129 into the circumferential gap 127, but also causes a flow of liquid metal from the circumferential gap 127 into the outlet channel 45', and from the outlet channel 45' via the heat exchanger 47' and the supply channel 43' back into the chamber 103 again. In this manner, the pumping action in the first disc-shaped gap 123 causes an effective circulation of the liquid metal in the channel system 157, as a result of which the liquid metal, which is heated in the impingement position 161 and which is in some degree distributed over the first annular gap 129 as a result of the flow component $F_T$, is effectively transported towards and cooled down again by the heat exchanger 47'.

In the embodiment of FIG. 4, a further pumping groove 169 is provided in the second main outer surface 169 of the carrier 115 for generating an additional radial flow $R_2$ of the liquid metal in the second disc-shaped gap 125. The additional radial flow $R_2$ enhances the circulation of the liquid metal in the channel system 157. However, the invention also encloses an embodiment in which only the first main outer surface 117 is provided with pumping means. The invention also encloses an embodiment in which no pumping means are provided on the main outer surfaces 117 and 119. In such an embodiment, a radial pumping action is still achieved as a result of the fact that in the disc-shaped gaps 123, 125 a rotational flow of the liquid metal is caused by friction forces exerted by the rotating carrier 115 on the liquid metal, said rotational flow causing centrifugal forces on the liquid metal, which result in a radial flow of the liquid metal.

Like in the device 1, the relatively large flow component $F_T$ is achieved by means of shear forces in the liquid metal generated by the moving contact surface 163, so that the flow component $F_T$ does substantially not lead to a pressure increase of the liquid metal. The rate of the flow component $F_R$, necessary to achieve sufficient circulation of the liquid metal through the channel system 157, is small relative to the rate of the flow component $F_T$. As a result the pressure increase, which is to be generated by the pumping groove 167 to force the liquid metal through the relatively narrow duct 143 and the first annular gap 129, is relatively small. As a result, like in the device 1, the pressure of the liquid metal in the device 101 is relatively low, resulting in a relatively low constructional weight of the device 101. Like the device 1, the device 101 has a compact and practical construction in that the displacing member 113 is integrated into the device 101 in a compact and practical manner.

Figure 6:
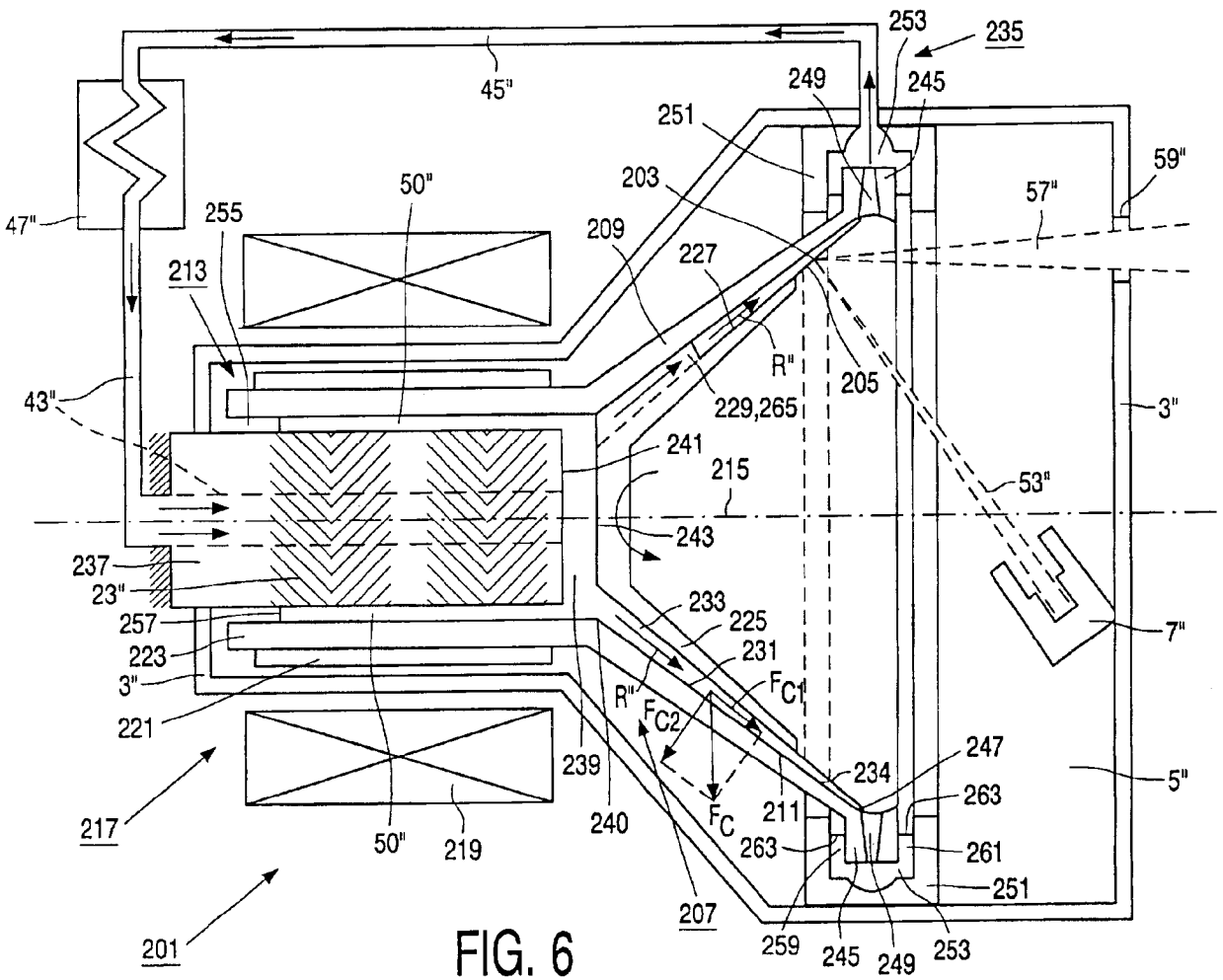

In FIG. 6 parts of the third embodiment of a device 201 for generating X-rays according to the invention, which correspond to parts of the device 1 as shown in FIGS. 1–3, are indicated with corresponding reference numbers. In the following, the differences between the devices 1 and 201 will be discussed. An important difference is that the device 201 has an impingement position 203 in which the liquid metal is not separated from the vacuum space 5" by means of an X-ray and electron transparent window, like in the devices 1 and 101, but in which the liquid metal has a free surface 205 in the vacuum space 5". Contamination of the vacuum space 5" by the liquid metal is prevented in a manner which will be discussed hereinafter. Due to the absence of an X-ray and electron transparent window in contact with the liquid metal, which window usually is rather fragile, the risk of malfunction of the device 201 is considerably reduced.

The device 201 comprises a displacing member 207 which, for the greater part, is accommodated in the vacuum space 5", which is enclosed by the housing 3" and which also accommodates the source 7". The displacing member 207 comprises a conical carrier 209 having a substantially conical inner surface 211. The carrier 209 is journalled by means of a dynamic groove bearing 213 so as to be rotatable about a central axis 215 of the conical inner surface 211. The bearing 213 only comprises a radial bearing part 23" for generating bearing forces in radial directions. In the device 201, the necessary bearing forces in the axial direction are generated in a manner to be discussed hereafter. The displacing member 207 is further provided with a driving member 217 for rotating the carrier 209 about the central axis 215. Like the driving member 31 of the device 1, the driving member 217 comprises an induction motor with a stator part 219, which is present outside the housing 3" and the vacuum space 5", and with a rotor part 221, which is present in the vacuum space 5" and is mounted to a circular-cylindrical bearing part 223 of the bearing 213. The displacing member 207 also comprises a further conical carrier 225 having a substantially conical outer surface 227 which is concentric with the conical inner surface 211 of the carrier 209. The further carrier 225 is mounted to the carrier 209 by means of mounting means 229 which will be discussed hereinafter. The further carrier 225 partially covers the carrier 209, so that a conical gap 233 is present between said outer surface 227 and a portion 231 of the inner surface 211 covered by the further carrier 225, and so that an annular portion 234 of the inner surface 211, which is present near a first edge 247 of the inner surface 211 where the inner surface 211 has its largest diameter, is not covered by the further carrier 225.

The conical gap 233 forms part of a cyclical channel system 235 in which a liquid metal for emitting X-rays as a result of the incidence of electrons is present. Said channel system 235 further comprises the outlet channel 45", the heat exchanger 47", and the supply channel 43", which partially extends in a static bearing part 237 of the bearing 213. The channel system 235 further comprises a chamber 239, which is present near a second edge 240 of the inner surface 211, where the inner surface 211 has its smallest diameter, and which is enclosed by an end surface 241 of the static bearing part 237 and by an end surface 243 of the further carrier 225. The channel system 235 further comprises an annular end portion 245, which is mounted to the carrier 209 near the first edge 247 of the inner surface 211 and which is provided with radially extending openings 249, and an annular collector 251, which is mounted to the housing 3" and extends along the circumference of the end portion 245. The collector 251 has an annular further chamber 253 to which the outlet channel 45" is connected. The liquid metal is also present as a necessary lubricant in the bearing gap 50" of the dynamic groove bearing 213, which bearing gap 50" is connected to the chamber 239. In an end portion 255 of the bearing gap 50", the liquid metal has a meniscus 257, as a result of which contamination of the vacuum space 5" by liquid metal leaking from the bearing gap 50" is prevented.

During operation, the device 201 is preferably in a position in which the central axis 215 extends in vertical direction and the inner surface 211 of the carrier 209 is oriented upwards. A flow of the liquid metal in the channel system 235 is achieved by rotating the carrier 209 about the central axis 215 at a relatively high velocity by means of the driving member 217. As a result of the rotation of the carrier 209 the liquid metal, which is in contact with the inner surface 211 of the carrier 209, is urged to rotate about the central axis 215 under the influence of friction forces between the inner surface 211 and the liquid metal and under the influence of viscous shear forces in the liquid metal. As a result of the rotation of the liquid metal, a centrifugal force $F_C$ shown in FIG. 6 is exerted on the liquid metal in contact with the inner surface 211. A first component $F_{C1}$ of the centrifugal force $F_C$, which is directed parallel to the inner surface 211, causes a radial flow R" of the liquid metal from the second edge 240 of the inner surface 211 to the first edge 247. A second component $F_{C2}$ of the centrifugal force $F_C$, which is directed perpendicularly to the inner surface 211, urges the liquid metal to maintain in contact with the inner surface 211, in particular with the annular portion 234 which is not covered by the further carrier 225, so that contamination of the vacuum space 5" by liquid metal spraying from the inner surface 211 is prevented as much as possible. As a result of the presence of the further carrier 225 and the conical gap 233, the rotational velocity of the liquid metal in contact with the inner surface 211, in particular of the portion of the liquid metal in contact with the portion 231 of the inner surface 211, and hence the centrifugal force $F_C$ are further increased as a result of friction forces between the liquid metal and the outer surface 227 of the further carrier 225.

Under the influence of said radial flow R" and the centrifugal forces acting on the liquid metal near the second edge 247, the liquid metal is urged to flow further through the openings 249 of the annular end portion 245 into the further chamber 253 of the collector 251. As shown in FIG. 6, the further chamber 253 is closed by the annular end portion 245, two relatively narrow annular gaps 259 and 261 being present between the collector 251 and the annular end portion 245. In said gaps 259 and 261, the liquid metal has a meniscus 263, as a result of which contamination of the vacuum space 5" by liquid metal leaking from the further chamber 253 is prevented. Due to the presence of the liquid metal in said relatively narrow gaps 259 and 261, an effective axial bearing function is achieved by the annular end portion 245 rotating in the collector 251. In this manner, the annular end portion 245 and the collector 251 also constitute an axial bearing for generating the necessary bearing forces in the axial direction for the carrier 209. Under the influence of the flow of liquid metal into the further chamber 253, an increase of the pressure of the liquid metal in the further chamber 253 is obtained, as a result of which the liquid metal is urged to flow further into the outlet channel 45", the heat exchanger 47", the supply channel 43", and back into the chamber 239, from which the liquid metal is supplied again to the inner surface 211. In this manner, the liquid metal is effectively urged to circulate in a closed loop through the channel system 235.

In the embodiment of FIG. 6 the mounting means 229, by means of which the further carrier 225 is mounted to the carrier 209, are constituted by a plurality of pumping vanes 265, which are not further shown in detail in the figure and which are of a type, known to the skilled person, providing a radial pumping action in the conical gap 233 in a direction towards the first edge 247. Said pumping action of the vanes 265, which is obtained by a transfer of momentum of the vanes 265 to the liquid metal present in the conical gap 233, considerably increases the radial flow R". It is noted, however, that the mounting means 229 may alternatively comprise conventional mounting members which do not have a pumping effect. It is further noted, that the invention also covers an embodiment, in which the further conical carrier 225 is absent and in which accordingly the rotation of the liquid metal is only the result of friction forces between the liquid metal and the inner surface 211 of the rotating carrier 209. It is further noted that the invention also covers embodiments in which the device 201 is in a position in which the central axis 215 does not extend in vertical direction. Such an embodiment is possible if the centrifugal force $F_C$ is substantially larger than the gravity force acting on the liquid metal. To prevent the liquid metal from dripping or flowing into the vacuum space 5" when the device 201 is not in operation and the carrier 209 is not rotated, the device 201 is provided with a system of valves and with a reservoir, in which the liquid metal is collected before the device 201 is stopped, and from which the liquid metal is released again after the device 201 has been started and the carrier 209 has started to rotate. Said valves and reservoir are not shown in the figure and may be of a type known to the skilled person.

Figure 7:
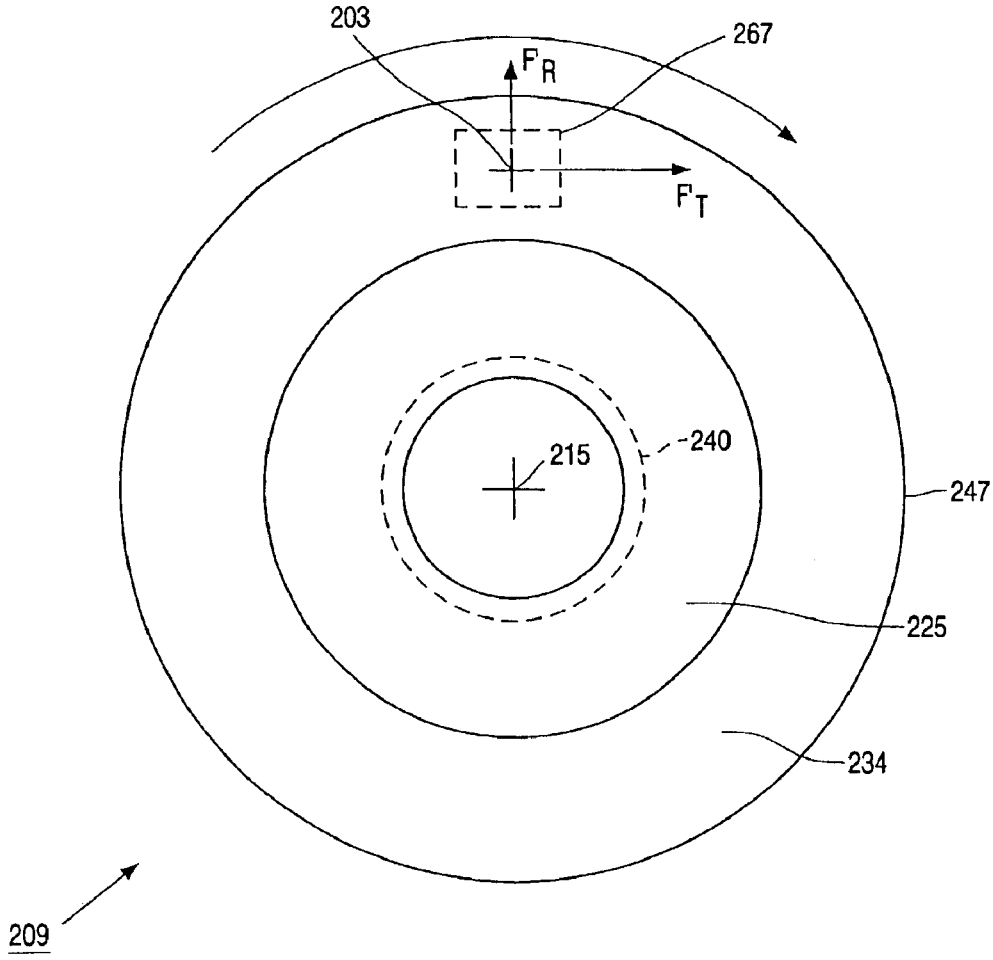

During operation of the device 201, with a circulation of liquid metal in the channel system 235 as described before, the electron beam 53" generated by the source 7" impinges upon the liquid metal in the impingement position 203 which is present on the annular portion 234 of the inner surface 211 not covered by the further carrier 225. The X-rays 57", emitted by the liquid metal in the impingement position 203, emanate through the X-ray exit window 59" provided in the housing 3". Like in the device 101, also in the device 201 the heat generated in the impingement position 203 is transported away from the impingement position 203 by a flow of the liquid metal through the impingement position 203 generated by the rotation of the carrier 209 about the central axis 215. As schematically shown in FIG. 7, said flow has a component $F'_T$ in a tangential direction relative to the central axis 215 and a component $F'_R$ in a radial direction relative to the central axis 215.

The flow component $F'_T$ is a viscous shear flow which is generated as a result of the fact that the liquid metal in the impingement position 203 is in contact with a contact surface 267 of the displacing member 207, and that said contact surface 267 is moved, as a result of the rotation of the carrier 209 by means of the driving member 217, in said tangential direction. In the device 201, the contact surface 267 is a portion of the annular portion 234 of the inner surface 211 of the carrier 209. In the impingement position 203, said tangential direction of the flow component $F'_T$ is substantially parallel to the contact surface 267, so that the heat is transported away from the impingement position 203 in an effective manner and is in some degree distributed over the annular portion 234. The annular portion 234 including the contact surface 267 is present near the first edge 247 where the inner surface 211 has its largest diameter, and the rotational velocity of the carrier 209 is relatively high, so that the tangential velocity of the contact surface 267 and, hence, of the flow component $F'_T$ is relatively high, and a relatively high rate of heat transfer away from the impingement position 203 is achieved. The flow component $F'_R$ corresponds to the radial flow R" mentioned herebefore causing the circulation of the liquid metal through the channel system 235. As a result of said circulation the liquid metal, which is heated in the impingement position 203 and which is in some degree distributed over the annular portion 234 of the inner surface 211 as a result of the flow component $F'_T$, is effectively transported towards and cooled down again by the heat exchanger 47".

As described before, like in the devices 1 and 101 the flow component $F'_T$ is achieved, at least partially, by means of shear forces in the liquid metal generated by the moving contact surface 267, so that the flow component $F'_T$ does substantially not lead to a pressure increase of the liquid metal. The pressure increase of the liquid metal, which is caused by the radial flow R" and by the centrifugal forces of the liquid metal in the annular end portion 245 and which causes the liquid metal to circulate through the channel system 235, is relatively small as a result of suitable dimensions of the outlet channel 45", the heat exchanger 47", the supply channel 43", and the conical gap 233. As a result, like in the devices 1 and 101, the pressure of the liquid metal in the device 201 is relatively low, resulting in a relatively low constructional weight of the device 201. Like the devices 1 and 101, the device 201 has a compact and practical construction in that the displacing member 207 is integrated into the device 201 in a compact and practical manner.

The invention is of course not limited to the described or shown embodiments, but generally extends to any embodiment, which falls within the scope of the appended claims as seen in light of the foregoing description and drawings. While a particular feature of the invention may have been described above with respect to only one of the illustrated embodiments, such features may be combined with one or more other features of other embodiments, as may be desired and advantageous for any given particular application. From the above description of the invention, those skilled in the art will perceive improvements, changes and modification. Such improvements, changes and modification within the skill of the art are intended to be covered by the appended claims.

Having described a preferred embodiment of the invention, the following is claimed:

1. A device for generating X-rays comprising a source for emitting electrons, a liquid metal for emitting X-rays as a result of the incidence of electrons, and a displacing member for displacing the liquid metal through an impingement position where the electrons emitted by the source impinge upon the liquid metal, wherein the displacing member comprises a contact surface in contact with the liquid metal in the impingement position, and a driving member for moving the contact surface in a direction which, in the impingement position, is substantially parallel to the contact surface.

2. The device for generating X-rays of claim 1, wherein the source is accommodated in a vacuum space which is separated, near the impingement position, from the liquid metal by a window made from a material which is transparent to X-rays and electrons, the contact surface and the window constituting opposite walls of a duct for the liquid metal.

3. The device for generating X-rays of claim 2, wherein the duct forms part of a closed cyclical channel system comprising a heat exchanger.

4. The device for generating X-rays of claim 2, wherein the displacing member comprises a carrier, which has a substantially circular-cylindrical outer surface and is rotatable about a central axis of the outer surface by means of the driving member, the contact surface forming part of the outer surface.

5. The device for generating X-rays of claim 2, wherein the displacing member comprises a substantially disc-shaped carrier which is rotatable about its central axis by means of the driving member, the contact surface forming part of an annular portion of a first main outer surface of the carrier, which portion is present near the circumference of the carrier.

6. The device for generating X-rays of claim 3, wherein the carrier is arranged in a substantially circular-cylindrical chamber and a first substantially disc-shaped gap is present between a first main inner surface of the chamber and the first main outer surface of the carrier, a second substantially disc-shaped gap is present between a second main inner surface of the chamber and a second main outer surface of the carrier, and a substantially annular circumferential gap is present between a circumferential inner surface of the chamber and a circumferential outer surface of the carrier, the channel system comprising a supply channel, which is connected to the chamber near the central axis, and an outlet channel, which is connected to the circumferential gap, the heat exchanger being arranged between the supply channel and the outlet channel.

7. The device for generating X-rays of claim 6, wherein at least the first main outer surface of the carrier is provided with pumping means for providing a radial pumping action in the first disc-shaped gap.

8. The device for generating X-rays of claim 1, wherein the displacing member comprises a carrier, which has a substantially conical inner surface and is rotatable about a central axis of the inner surface by means of the driving member, wherein the carrier and the source are accommodated in a common vacuum space, and wherein the contact surface forms part of an annular portion of the inner surface which is present near an edge of the inner surface where the inner surface has its largest diameter.

9. The device for generating X-rays of claim 8, wherein the displacing member comprises a further carrier, which is connected to the carrier and has a substantially conical outer surface, wherein a substantially conical gap is present between the outer surface and the inner surface, and wherein the annular portion of the inner surface is not covered by the further carrier.

10. The device for generating X-rays of claim 9, wherein the further carrier is connected to the carrier by means of pumping vanes, which are present in the gap for providing a radial pumping action in the gap.

11. The device for generating X-rays of claim 8, wherein the liquid metal is supplied to the inner surface from a chamber which is present near an edge of the inner surface where the inner surface has its smallest diameter, wherein the device further comprises a supply channel, which is connected to the chamber, an outlet channel, which is connected to an annular further chamber surrounding the edge of the inner surface where the inner surface has its largest diameter, and a heat exchanger arranged between the supply channel and the outlet channel.

12. The device for generating X-rays of claim 4, wherein the carrier is rotatably journalled by means of a dynamic groove bearing comprising a bearing gap filled with the liquid metal.

13. A device for generating X-rays of claim 5, wherein the carrier is arranged in a substantially circular-cylindrical chamber and a first substantially disc-shaped gap is present between a first main inner surface of the chamber and the first main outer surface of the carrier, a second substantially disc-shaped gap is present between a second main inner surface of the chamber and a second main outer surface of the carrier, and a substantially annular circumferential gap is present between a circumferential inner surface of the chamber and a circumferential outer surface of the carrier, the channel system comprising a supply channel, which is connected to the chamber near the central axis, and an outlet channel, which is connected to the circumferential gap, the heat exchanger being arranged between the supply channel and the outlet channel.

14. The device for generating X-rays of claim 5, wherein the carrier is rotatably journalled by means of a dynamic groove bearing comprising a bearing gap filled with the liquid metal.

15. The device for generating X-rays of claim 8, wherein the carrier is rotatably journalled by means of a dynamic groove bearing comprising a bearing gap filled with the liquid metal.

* * * * *